US005839729A

United States Patent [19]

Watanabe

[11] Patent Number: 5,839,729

[45] Date of Patent: Nov. 24, 1998

[54] BOARD GAME AND PLAYING PROCESS

[76] Inventor: Masato Watanabe, 147-4 Arahata, Tokorozawa-shi, Saitama 359, Japan

[21] Appl. No.: 814,470

[22] Filed: Mar. 10, 1997

[30] Foreign Application Priority Data

Jun. 3, 1996 [JP] Japan ..... 8-139810

[51] Int. Cl.[6] ..... A63F 3/00

[52] U.S. Cl. ..... 273/276

[58] Field of Search ..... 273/236, 239, 273/264, 271, 276, 282.1, 284

[56] References Cited

U.S. PATENT DOCUMENTS

| | | | |
|---|---|---|---|
| 3,638,947 | 2/1972 | Hardesty . | |
| 4,739,992 | 4/1988 | May | 273/243 |
| 5,269,531 | 12/1993 | McNamara | 273/275 |
| 5,301,953 | 4/1994 | Levin | 273/276 |
| 5,324,040 | 6/1994 | Panda | 273/272 |
| 5,344,153 | 9/1994 | Watanabe | 273/271 |

FOREIGN PATENT DOCUMENTS

| | | |
|---|---|---|
| 2181630 | 12/1973 | France . |
| 2 033 239 | 5/1980 | United Kingdom . |
| 2 191 953 | 12/1987 | United Kingdom . |
| 95/32775 | 12/1995 | WIPO . |

*Primary Examiner*—William E. Stoll
*Attorney, Agent, or Firm*—Foley & Lardner

[57] ABSTRACT

A game board has a board surface having a regular periodic pattern of seven identical regular hexagonal frames, one surrounded by the other six. Each frame is divided into 24 unit equilateral triangles by grid lines. Players in turns place polygonal playing pieces of different shapes, one by one, on the pattern so as to form a polygonal figure formed by one or more pieces on the board, covering a congruent polygonal figure defined by one or more unit triangles. Each player gains a predetermined number of points when the player can put a new piece in contact with the polygonal figure of the piece or pieces on the board along a full length of one side of the new piece.

15 Claims, 12 Drawing Sheets

BOARD GAME AND PLAYING PROCESS

BACKGROUND OF THE INVENTION

The present invention relates to board game playing process and system which are simple, easy and exciting.

There are a wide variety of board games. However, some are complicated, difficult to play, and inappropriate as amusement for a wide range of age. Some are no longer fresh and exciting.

SUMMARY OF THE INVENTION

It is an object of the present invention to provide an easy, new, exciting board game for two or more players.

According to the present invention, a playing process of playing a board game comprises:

a preparing step of preparing a game board having a regular pattern which comprises a frame in a shape of a regular polygon divided into a predetermined number of unit equilateral triangles by regular grid lines;

a distributing step of distributing a predetermined set of playing pieces among players so that each player has a predetermined subset of playing pieces, each of said playing pieces being in a shape of a polygonal figure which can be superimposed on the pattern so that each side of the polygonal figure lies on one of the grid lines; and a forming step of forming a polygonal mosaic on the board by allowing each player in turn to place one piece in conformity with said pattern on the board in such a manner that an entirety of one side of a newly placed piece adjoins one side of the polygonal mosaic on the board.

A board game set according to one embodiment of the present invention comprises:

a game board comprising a regular periodic pattern of grid lines defining unit polygonal figure in a shape of an equilateral triangle, and multi-unit polygonal figures each of which is formed by a plurality of the unit polygonal figures connected together side by side; and a piece group comprises small triangular pieces, large triangular pieces, small rhombic pieces, large rhombic pieces, small trapezoidal pieces, large trapezoidal pieces, and hexagonal pieces, each piece being shaped in a polygonal figure congruent with one of said polygonal figures defined by said grid lines.

BRIEF DESCRIPTION OF DRAWINGS

FIG. 8A illustrates an initial state, FIG. 8B illustrates a wrong example, and FIG. 8C illustrates a good example.

FIG. 9A illustrates an initial state and FIGS. 9B, 9C and 9D illustrate three good examples.

DETAILED DESCRIPTION OF THE INVENTION

Figure 1:
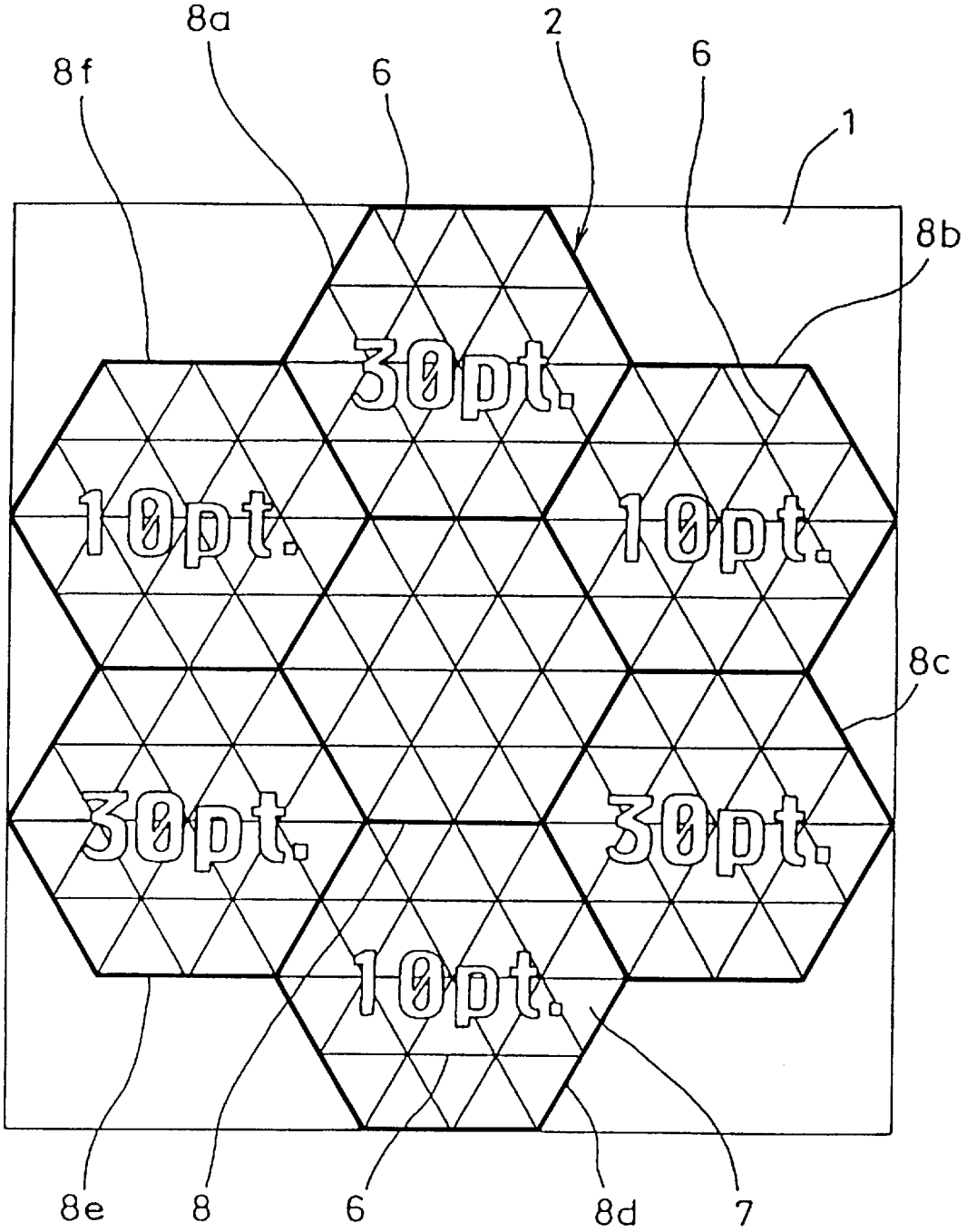
Fig. 1 is a plan view of a game board according to a first embodiment of the present invention.
Figure 2:
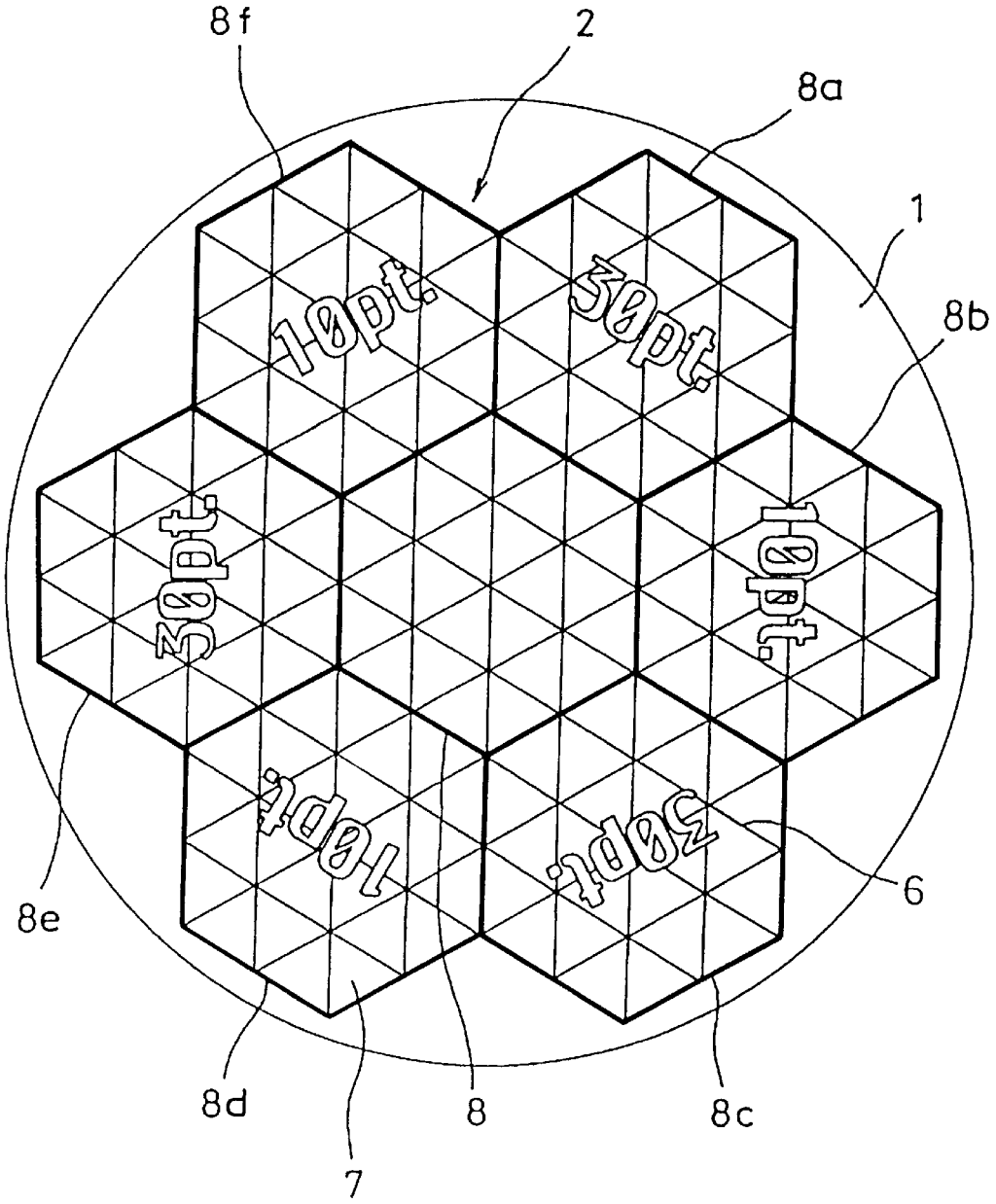
FIG. 2 is a plan view showing a variation of the game board according to the first embodiment.
Figure 3:
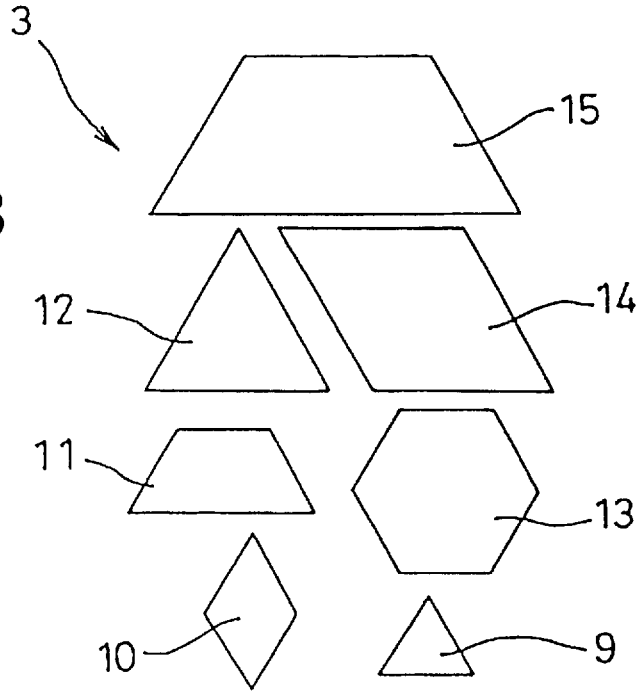
FIG. 3 is a plan view showing playing pieces according to the first embodiment of the present invention.
Figure 4:
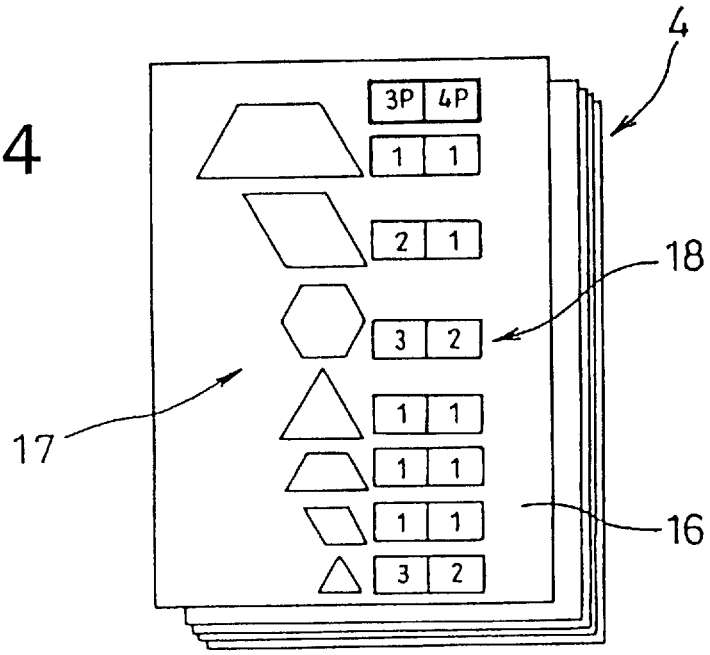
FIG. 4 is a plan view showing playing cards employed in the first embodiment of the present invention.
Figure 5:
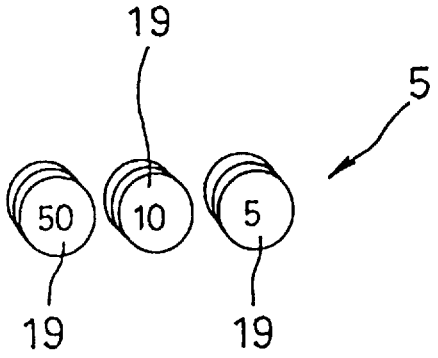
FIG. 5 is a perspective view showing coins employed in the first embodiment of the present invention.

FIGS. 1, 3, 4 and 5 show a board game set according to a first embodiment of the present invention. FIG. 1 shows a playing game board. FIG. 3 shows playing pieces of different kinds. FIGS. 4 and 5 show cards and coins, respectively. FIG. 2 shows a variation of the game board. The game is designed for two to four players.

A game board 1 according to this embodiment is a polygonal or circular board made of paper, cardboard, wood or plastic. The board 1 shown in FIG. 1 is square. In the example shown in FIG. 2, the board 1 is circular. The board 1 has a planar board surface having a playing pattern 2 defined by grid lines 6. In this example, the playing pattern 2 is printed on the board surface. It is optional to provide a description of the playing process and rules on the back side surface of the board. The board 1 may have one or more detachable or foldable legs so that the board 1 can be used in the form of a table.

The playing pattern 2 of the example shown in FIG. 1 consists of seven regular hexagonal frames or zones 8 and 8*a*~8*f* defined by a network shown by thick lines in FIG. 1. The hexagonal frames or zones 8 and 8*a*~8*f* are all in the form of a regular hexagon, and all are equal in size. The hexagonal frame 8 is surrounded by the other six hexagonal frames 8*a*~8*f*. Each of the equal six sides of the center hexagonal frame 8 forms one side of a unique one of the 6 surrounding hexagonal frames 8*a*~8*f*. Therefore, each vertex of the center hexagonal frame 8 is shared by the center frame 8 and two adjacent surrounding frames.

Each of the hexagonal frames 8 and 8*a*~8*f* is divided into 24 equal equilateral triangles 7 by the grid lines 6 passing therethrough. In each hexagonal frame (or zone), the 24 equilateral triangles 7 are defined by three diagonals passing through the center of the hexagon and six mid-lines each of which is a mid-line of a trapezoid defined by three consecutive sides and one diagonal of the hexagon. Each of the grid lines is parallel to, or coincident with, one of the three center-passing diagonals of the center frame (or zone) 8.

In this example, a bonus of 30 points is marked in each of the frames 8*a*, 8*c* and 8*e*, and a bonus of 10 points is marked in each of the frames 8*b*, 8*d* and 8*f*. The marks of the 30 point bonus and the marks of the 10 point bonus are alternately arranged around the center frame 8. In the example of FIG. 1, the bonus points (or zone points) are all written horizontally from left to right. In the example of FIG. 2, the bonus points are written in a circle around the center frame 8 in the clockwise direction.

A playing piece group 3 includes thin flat playing pieces which are grouped into seven subgroups by shapes as shown in FIG. 3. Each subgroup includes a plurality of identical playing pieces. FIG. 3 shows only one piece of each subgroup for simplification. A first subgroup includes small triangular pieces 9 having the shape of one unit equilateral triangle 7 defined by three of the grid lines 6 on the board 1. A second subgroup includes small rhombic pieces 10 having the shape of a rhombus formed by two unit equilateral triangles 7. Small trapezoidal pieces 11 belonging to a third subgroup have the shape of a trapezoid formed by three unit equilateral triangles 7. Large triangular pieces 12 of a fourth subgroup have the shape of an equilateral triangle formed by four unit triangles 7. Hexagonal pieces 13 of a fifth subgroup have the shape of a regular hexagon formed by six unit triangles 7. Large rhombic pieces 14 of a sixth subgroup are in the shape of a rhombus formed by eight unit triangles 7. Large trapezoidal pieces 15 of a seventh subgroup are in the shape of a trapezoid formed by twelve unit triangles 7. Each large trapezoidal piece 15 has the area which can occupy a half of the hexagon of the hexagonal frames 8 and 8*a*~8*f*.

A playing card group 4 as shown in FIG. 4 includes a plurality of playing cards 16 indicating the number of playing pieces of each playing piece subgroup to be distributed to a player at a start of a game. Each card has a left side column 17 including seven plane figures representing the seven different shapes of the playing pieces, and a right side column 18 indicating the number of pieces for each shape. In the example shown in FIG. 4, the right side column includes two digits for each shape, one for a three player game (represented by 3P) and the other for a four player game (4P). Each digit on the right side column 18 is 1, 2, 3 or 4. There are a total of 54 cards 16.

A coin group 5 of the example shown in FIG. 5 includes coins 19 which are all made of plastic, for example, in the same shape and size, but colored in three different colors. The coins of the first color are 5 point coins, and have a mark indicating 5 points. The coins of the second color are 10 point coins with a mark of 10 points. The coins of the third color are 50 point coins with a mark of 50 points. It is optional to change the shapes, sizes and colors of the coins appropriately as long as the three different types of the coins are discernible.

The playing process of this board game is as follows.

First, the fifty four cards 16 are well shuffled like trump cards, and then stacked back side up near the board 1. The coins 19 are also placed near the board 1. The order is determined by the paper-stone-scissors game, dice-throwing, coin-tossing or some other way. In the case of a three or four player game, the order of the players' positions in the counterclockwise direction around the board is convenient.

Figure 6:
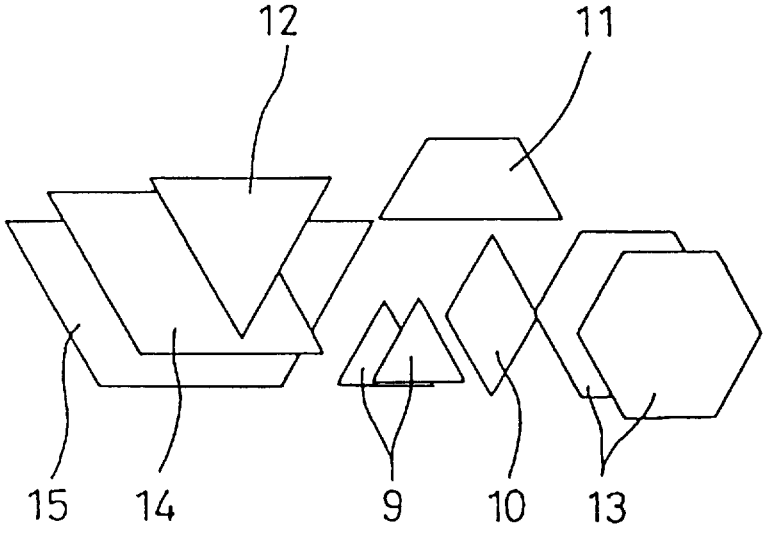
FIG. 6 is a schematic view showing, as an example, a set of playing pieces distributed to one player according to one of the cards shown in FIG. 4.

Second, each of the players in the predetermined order turns up one card, and place the card face side up so that the other players can see the instructions on the card. Each player takes a predetermined number of playing pieces from each subgroup of the playing piece group 3 as instructed by the card in hand. For example, one player takes the playing pieces 9~15 shown in Fig. 6 according to the instructions for the four player game (4P) on the card 16 shown in FIG. 4. The pieces shown in FIG. 6 are the hand held by this player at the beginning of the game. In the case of a two player game, each player turns up two of the cards 4 and selects from the pieces following the instructions in the 4P columns of both cards.

Then, in the predetermined order, each player selects a desired one of the pieces 9~15 from his or her hand, and places the selected piece on the board 1 so that the pieces on the board 1 are connected to form a polygonal plane figure defined by line segments of the grid lines 6.

Figure 7A:
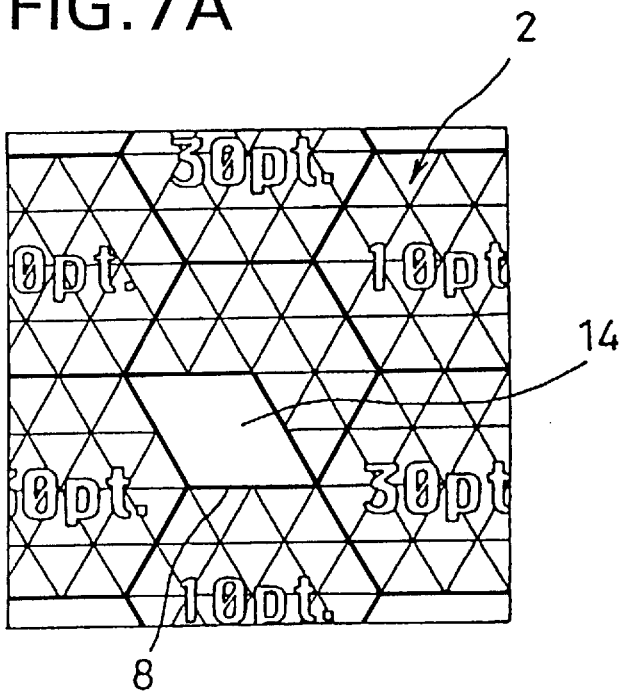
FIGS. 7A and 7B are plan views showing playing pieces on the game board shown in FIG. 1 for illustrating play rules for a first piece.
Figure 7B:
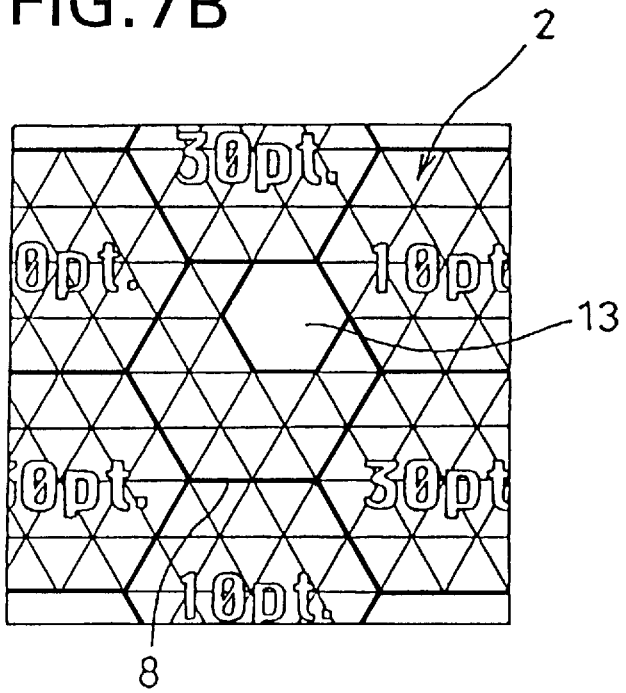

The first piece which is placed first on the board must satisfy the following conditions. The first piece must be placed within the center hexagonal frame (or zone) 8, and at least one side of the first piece must be entirely in contact with one of the sides of the center hexagonal frame (or zone) 8, as shown in FIGS. 7A and 7B. Furthermore, each of the remaining sides of the first piece entirely lies on one of the grid lines 6.

Figure 8A:
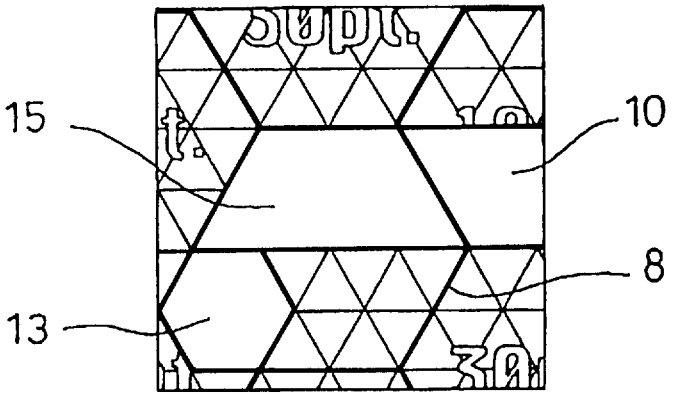
FIGS. 8A, 8B and 8C are plan views showing pieces on the board shown in FIG. 1.
Figure 8B:
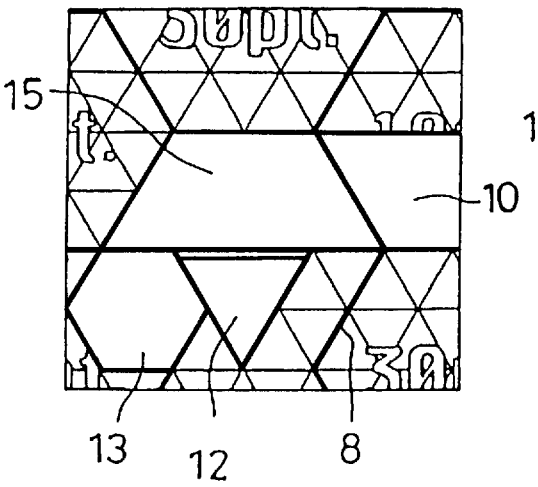
Figure 8C:
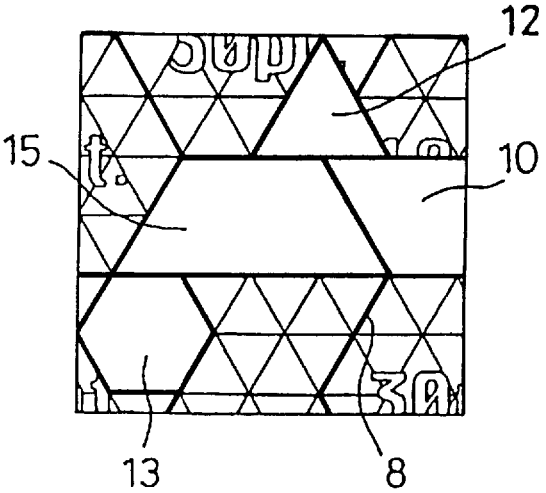
Figure 9A:
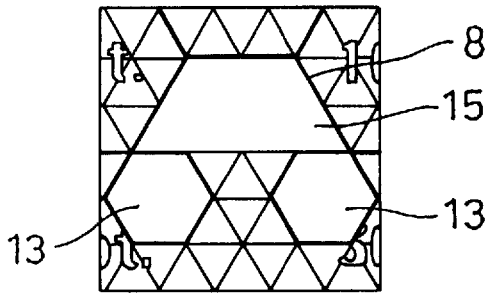
FIGS. 9A, 9B, 9C and 9D are plan views showing pieces on the board shown in FIG. 1.
Figure 9B:
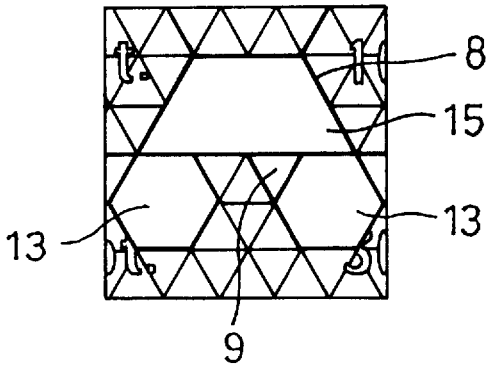
Figure 9C:
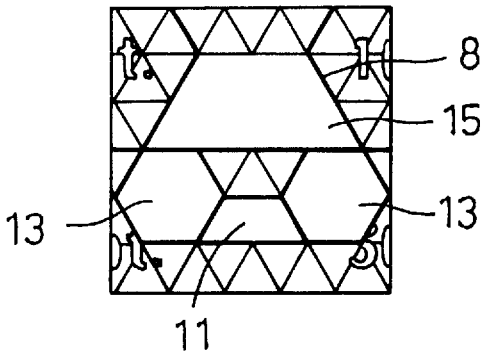
Figure 9D:
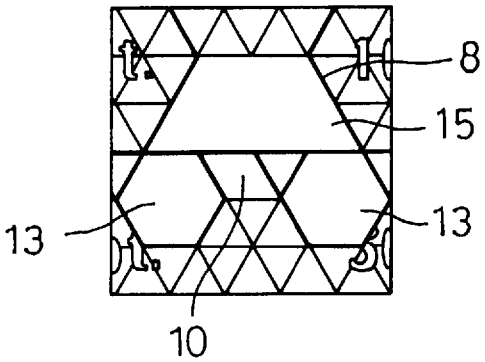

The second and subsequent pieces must satisfy the following conditions. The newly-placed, second or subsequent piece must be fitly superimposed on a polygonal plane figure formed by the grid lines 6 on the board 1, and the entirety of at least one side of the newly-placed piece must be in contact with one side of the polygonal plane figure formed by the piece or pieces already placed on the board 1. Each side of the newly placed piece must not be partly in contact with the polygonal figure of the already-placed piece or pieces on the board 1. None of the sides of the newly placed piece must be in a partly-connected state. That is, none of the sides of the newly placed piece extends, on one hand, on and along one side of the polygonal figure formed by one or more pieces on the board 1, and projects, on the other hand, beyond the polygonal figure on the board 1. Each side of the polygonal figure formed by two or more pieces on the board may be formed by two or more sides of different pieces arranged in a straight line on the board 1. Therefore, when three pieces 10, 15 and 13 are on the board 1 as shown in FIG. 8A, a piece 12 shown in FIG. 8B is not permissible because one half of the left side of the piece 12 shown in FIG. 7B is in contact with the adjacent hexagonal piece 13 on the board 1 but the other half projects beyond the hexagonal piece 13. A piece 12 shown in FIG. 8C is permissible. Two sides of the pieces on the board 1 are connected end to end to form a long straight side, and one side of the piece 12 of FIG. 8C is entirely on this long side of the polygonal figure on the board 1 In the case shown in FIG. 9A in which one large trapezoidal piece 15 and two hexagonal pieces 13 are on the board 1, any of a triangular piece 9 shown in FIG. 9B, a small trapezoidal piece 11 shown in FIG. 9C and a small rhombic piece 10 shown in FIG. 9C is permissible.

Figure 10A:
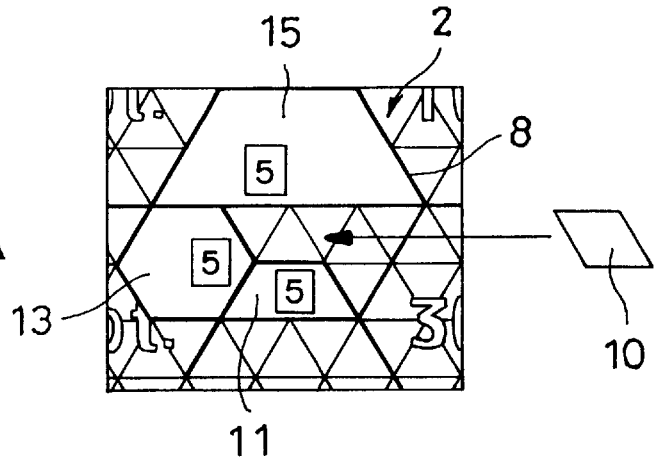
FIGS. 10A, 10B and 10C are plan views of pieces on the board of FIG. 1 for illustrating rules for scoring.

The players obtain points according to the number of contacting sides of a newly placed piece contacting with the piece or pieces on the board. Five points are awarded for each contacting side, and the players take coins corresponding to the earned points. In an example shown in FIG. 10A, there are, on the board 1, one small trapezoidal piece 11, one hexagonal piece 13 and one large trapezoidal piece 15, and the player who has placed one small rhombic piece 10 as shown by an arrow in FIG. 10A can gain a total of 15 points since three sides of the rhombic piece 10 are in contact with the polygonal figure formed by the pieces on the board 1. The earned coins 19 are placed openly.

Figure 10B:
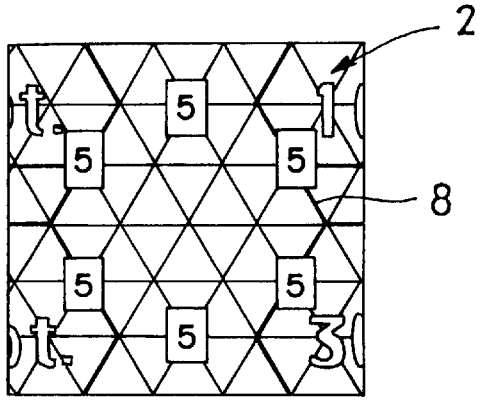
Figure 10C:
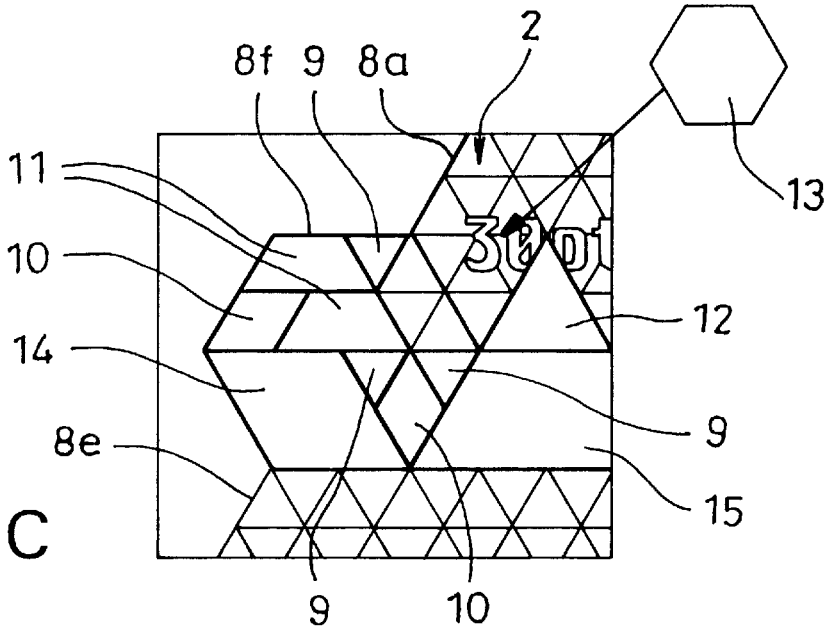

In the case of the first piece placed first on the board 1 by the first player, a side or each side contacting with one side of the center hexagonal frame 8 is counted for the score. As shown in Fig. 10B, five points are given if the first player can place one side of a piece in contact with any one of the six sides of the center hexagonal frame 8. If one of the surrounding hexagonal frames 8*a*~8*f* is entirely covered by the pieces already on the board and a newly placed piece, then the player who has placed the newly placed piece can obtain a bonus of 10 points or 30 points of the covered frame (or zone). In an example shown in FIG. 10C, one player places one hexagonal piece 13 on the frame 8*f*, so that the frame 8*f* becomes completely covered by the pieces on the board 1. In this case, the player who placed the hexagonal piece 13 can obtain the 10 point bonus of the frame 8*f* in addition to the points obtained according to the number of contacting sides of the hexagonal piece.

The player can declare "pass" if none of the remaining pieces in the hand is correctly connectable with the existing piece or pieces on the board 1, and wait for the next turn.

The game ends when each player has no playing pieces in hand, or when all the frames or zones are completely covered by pieces, so that there is left no space to place a piece.

The piece or pieces held by a given player at the end of the game are used as a penalty. Each side of a piece left over in the hand imposes a penalty of 5 points, and a total of penalty points are subtracted from the score. The final score is the result obtained by subtracting the total of penalty points from the sum of the total of normal points earned according to the number of contacting sides and the total of bonus points.

Figure 11:
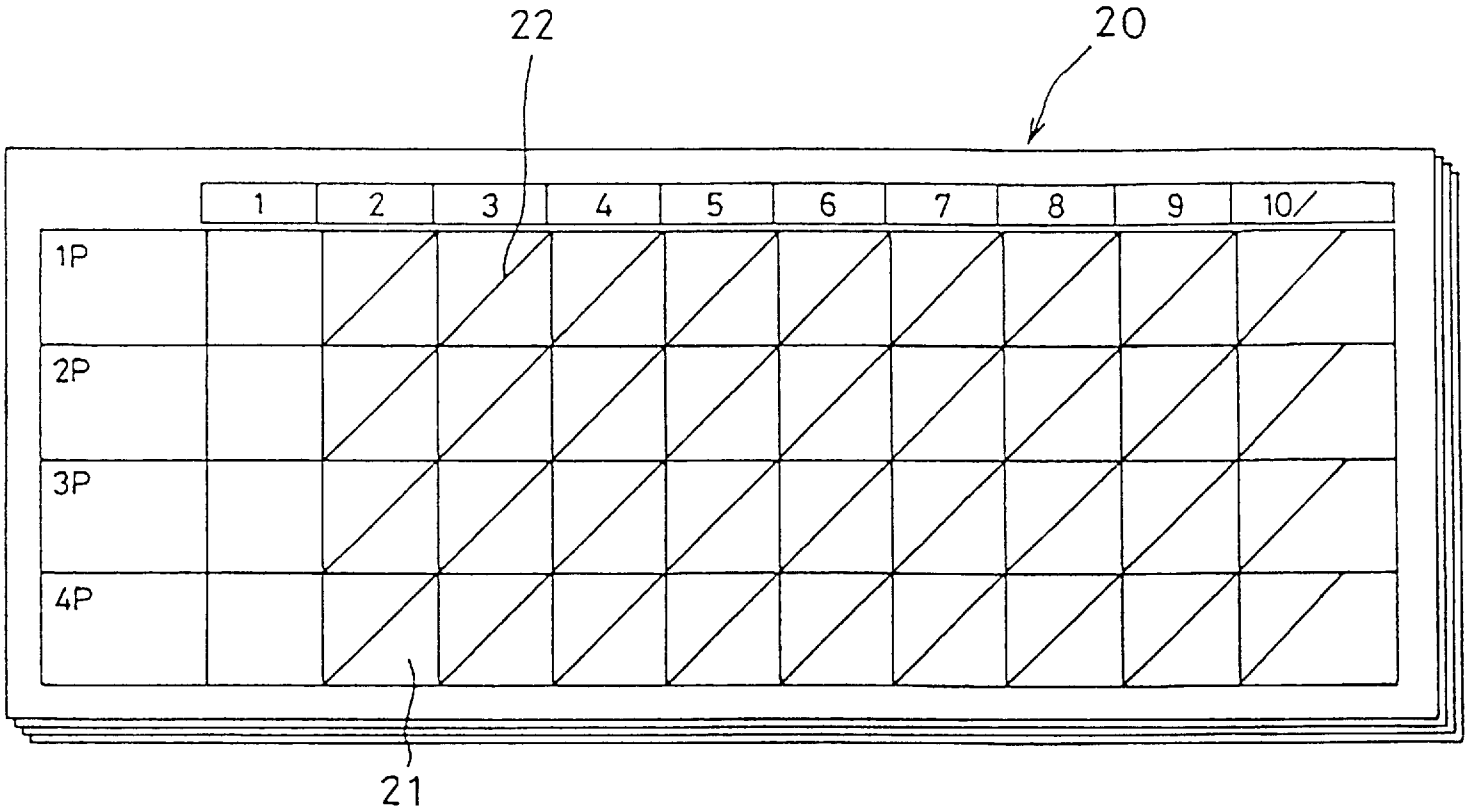
FIG. 11 is a plan view showing a score sheet employed in the first embodiment of the present invention.

FIG. 11 shows a score sheet 20 having four rows for four players and ten columns for ten rounds of a game. In this example, one game consists of ten rounds. Except for the first column for the first round, each box cell 21 is divided into two triangles by a diagonal line 22 so that the score of the current round and the total score of the current and preceding rounds can be entered. The score sheet 20 facilitates the scoring though the board game according to the present invention is possible without such a score table.

Various modification of the board game are possible. The pattern on the board 1 may be formed by only one hexagonal frame or zone 8, or only two frames or zones 8 and 8*a*, for example. The playing pieces may be more freely distributed among players without restriction on the numbers of pieces 9~15 by the cards 4. In this case, the game is similar but has fairly different taste. The frames may be in the form of another regular polygon such as a regular octagon. The number of unit regular triangles in each frame is not necessarily limited to 24. It is optional to employ pieces of different shapes formed by one or more unit triangles. The pieces and board can be made so that each piece is held on the board by magnetic force. For example, each piece has a back side layer of magnetic rubber sheet, and the board has a sheet of iron or magnetic rubber.

Figure 12:
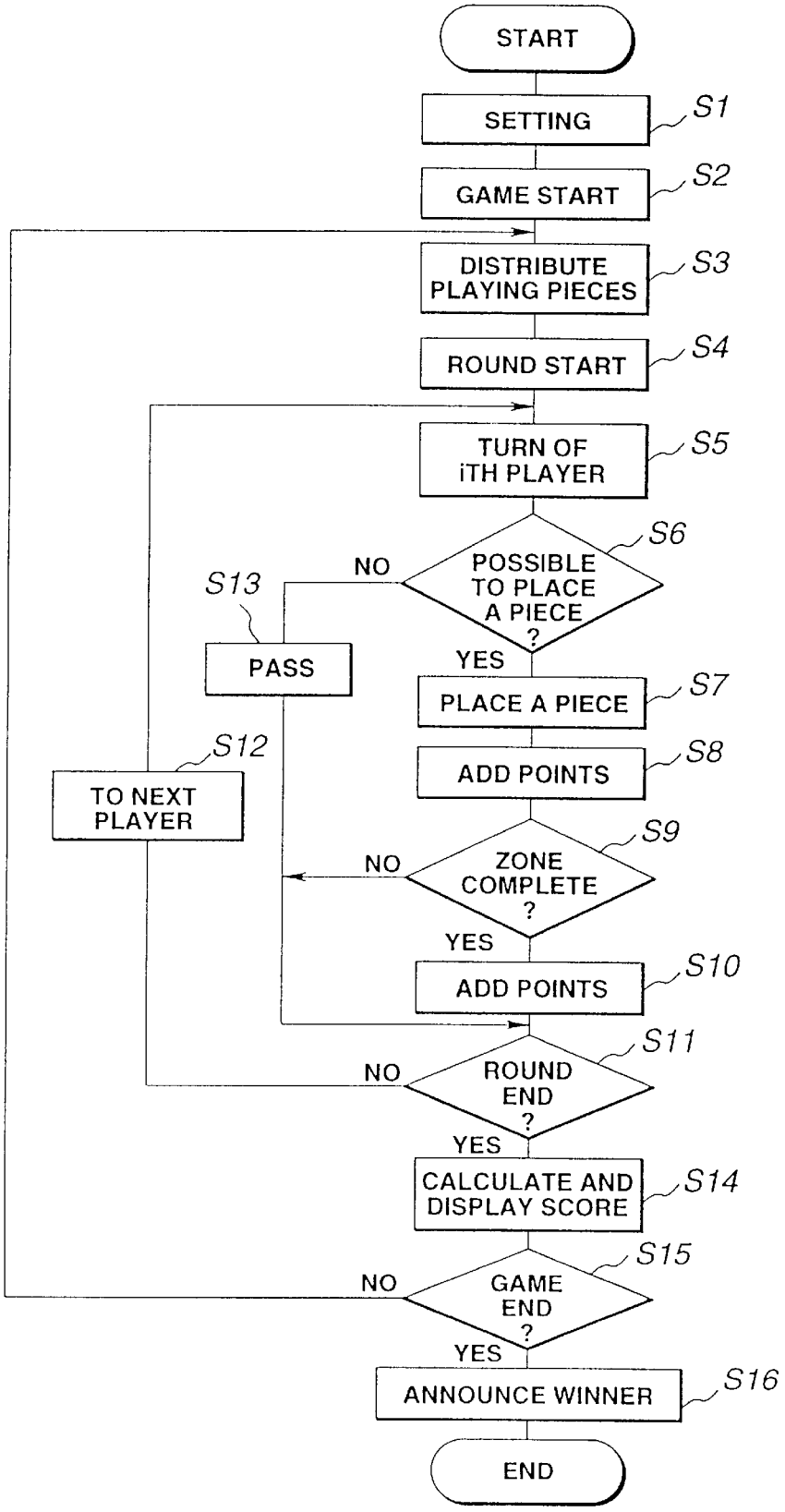
FIG. 12 a flowchart showing a board game process according to a second embodiment of the present invention.

FIG. 12 shows a board game process according to a second embodiment of the present invention. The board game process of this example is performed by a computer board game system shown in FIG. 13. In the second embodiment, the game board is an (electronic) image of the game board 1, and the playing pieces are (electronic) images of the playing pieces 9~15 which can be superimposed on the image of the game board on the screen of a display device.

At a step S1, the board game system allows players to set a number n of players, and a number of rounds. In the case of a two player game, the number n is two. Furthermore, the system enables the players to determine a playing order (or sequence) of the players. In this example, the system further offers the selection of background music and the selection of designs for the board and pieces.

At a step S2, the system allows the players to start the game.

At a step S3, the system distributes polygonal playing pieces among the players at random. In this example, the playing pieces are distributed randomly by the computer without using the playing cards 16 of the first embodiment. However, it is possible to utilize the digits of the cards 16 in the same manner as in the first embodiment. In this case, the system may allow the players to turn up a card on the computer screen by displaying the imagery of the cards 16. Alternatively, the system may select a card automatically without the intervention of the players and without displaying the cards, and use the digits of the selected card. In this case, each card is merely a collection of data items stored in the computer system.

Then, the system starts a round at a step S4, and determines that it is the ith player's turn, at a step S5, wherein i is any whole number from 1 to n. First, i is set equal to one so as to allow the first player to place a piece on the on-screen board. In the case of the two player game, i is one or two, and the first and second players are alternately allowed to place a piece.

At a step S6, the system checks whether any one or more of the playing pieces in the hand of the ith player can be placed on the board without violating the rules or required conditions. The rules or required conditions for placement of playing pieces on the board are the same as, those in the first embodiment. If none of the pieces of the ith player can be correctly placed on the board, then the system proceeds from the step S6 to a step S13 and automatically terminates the turn of the ith player.

If the answer of the step S6 is affirmative, the system allows the ith player to place a piece on the board at a step S7. As the ith player moves a playing piece on the on-screen board, for example, by dragging the on-screen playing piece with an input device such as a mouse, the system of this example shows the player the permissible position or positions where the piece can be correctly placed, by changing the color and/or design of pertinent segments of the grid lines.

At a step S8 following the step S7, the system adds a predetermined number of points to the score of the ith player according to the number of contacting sides. As in the first embodiment, five points are given if the ith player can put one side of a piece in contact with any one of the six sides of the center hexagonal frame 8 in the case of a first piece, or with any one of the sides of the figure formed by the piece or pieces on the board in the case of subsequent pieces.

At a step S9, the system checks whether any one or more of the surrounding peripheral zones or frames is completed by the ith player's action of the step S7. If it is, then the system adds the predetermined bonus points to the score of the ith player at a step S10, as in the first embodiment. After the step S10, the system proceeds to a step S11.

If the answer of the step S6 is negative, the system proceeds from the step S6 to the step S13, and considers that the ith player has declined to place a piece. If the answer of the step S9 is negative, then the system proceeds from the step S9 to the step S11 bypassing the step S10.

At the step S11, the system determines whether the predetermined conditions to terminate the round are satisfied or not. As in the first embodiment, the round ends when the hands or deals of all the players become empty, or when there is no space, on the board, to place a piece.

If the answer of the step S11 is negative, the system returns through a step S12 to the step S5. At the step S12, the system specifies the next player according to the predetermined playing order or sequence. If the answer of the step S11 is affirmative, then the system proceeds to a step S14. At the step S14, the system calculates the score of each player by performing a deducting operation with the normal reward, the special bonus and the penalty, and displays the results. The scoring rules are the same as those of the first embodiment. If, for example, the ith player has left unused one triangular piece and one rhombic piece, 35 points {=(3 +4) ×5}are deducted from the score of the ith player. After the step S14, the system proceeds to a step S15.

At the step S15, the system checks whether the predetermined number m of rounds are over. If they are not, the system returns to the step S3 to start the next round. If the predetermined number of rounds are completed, the system judges that the game consisting of the predetermined number of rounds is over and proceeds to a step S16. At the step S16, the system checks the total score of each player, determines whose score is greatest, and announce who is the winner.

Figure 13:
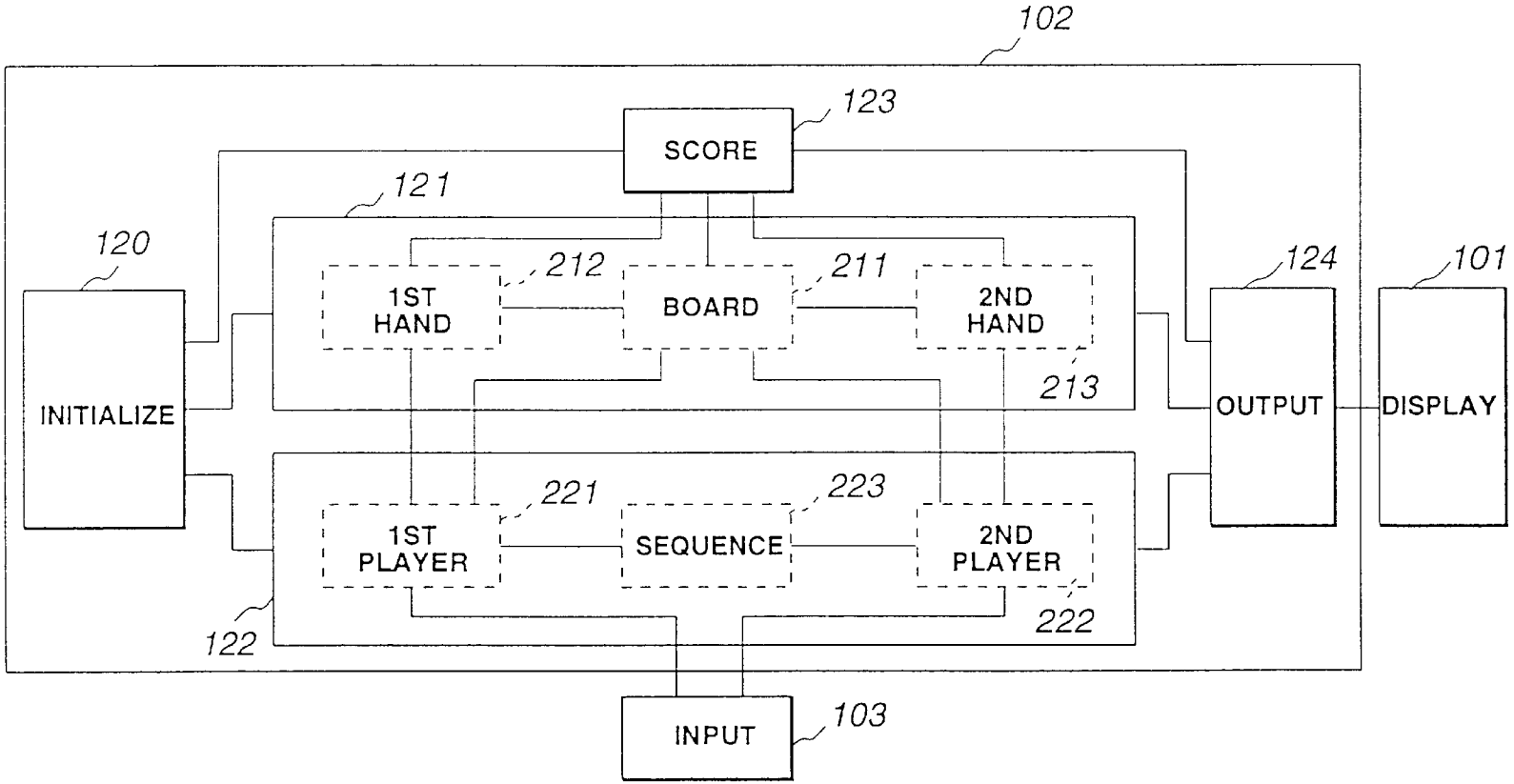
FIG. 13 is a block diagram showing a board game system according to the second embodiment of the present invention.

As shown in FIG. 13, the board game system of this example includes at least a first section 101 for displaying the images of the game board, pieces, the score and other information, and allowing the superposition of images of pieces on the image of the board; a second section 102 for controlling the first section; and a third section 103 for allowing each player to command the second section 102 to place a piece on the board.

The first section 101 is an output section which may be a display section external to a computer, or may be an output section of a computer for producing, storing and delivering picture signals to the external display device. The first section 101 of this example is a display section comprising a color display device. Instead, it is optional to employ a monochrome display device.

The third section 103 of this example is an input section adapted to be operated by the players. The input section 103 of this example comprises a mouse and a keyboard. Instead, the input section 103 may comprise a set of manual input devices for individual players especially when the system is in the form of a video game system. With the input section 103, each player can select a piece from the hand, and specify the location of placement of a piece on the board.

The first, second and third sections 101, 102 and 103 may be separate units connected electrically with one another or may be incorporated in a single unit. The size of the system may be of a desktop size, a notebook size, a hand-held size or a pocket size, for example.

The display device of this example shows the board at the center of the screen, the playing pieces of the first player's hand on the left side of the board, the playing pieces of the second player's hand on the right side, and the total scores of the first and second players on the upper side of the board. From the screen, the players can see the number of pieces of each polygonal shape in the hand of each player, and the covering figure formed by one or more pieces on the board.

The second section 102 of the example is a control section which, in this example, has, as a main component, a computer such as a microcomputer. As shown in FIG. 13, the control section 102 of this example includes at least an initializing subsection 120 for setting an integer n to a predetermined number of players, resetting a score of each player to zero, and resetting the board to an initial state and for distributing the polygonal pieces among the players; a first operating subsection or means 121 for monitoring pieces on the board and the hand of each player, for monitoring the placement of a piece to check whether the placement of a piece conforms to the required conditions and for providing electric signals to display the board and pieces, and other information on the screen of the display section 101; a second operating subsection or means 122 for selecting a piece from the hand of each player and specifying the location (or destination) of placement of the piece on the board in response to the command of each player; and a third subsection or means 123 for counting the scores of the players by counting the number of contacting sides as mentioned before, checking whether any one of the peripheral frames or zones is completely covered by pieces, and counting the number of sides of leftover pieces as mentioned before, and for determining who is the winner.

The first operating subsection 121 of the example shown in FIG. 13 comprises a board monitoring means 211 for specifying pieces on the board, and an ith player's hand monitoring means for specifying pieces in the hand of the ith player. The ith player's hand monitoring menas of this example includes a first player's hand monitoring means 212 and a second player's hand monitoring means 213.

The second operating subsection 122 of this example comprises an ith handling means for selecting a piece from the ith player's hand and for specifying the location on the board at which a piece is to be placed. In this example, the ith handing means comprises a first handling means 221 for serving for the first player and a second handing means 222 for serving for the second player. The ith handling means is connected with the input section 103. It is optional to connect a plurality of input devices of the input section 103, respectively, to a plurality of the ith handling means. The second subsection 122 of this example further comprises a sequence monitoring means 223 for monitoring the playing sequence or order of the players, and for sequentially enabling the ith handling means.

The control section 102 of this example further comprises an output subsection 124 for producing, storing and delivering picture signals to the display section 101 to display the board and pieces on the screen.

Figure 14:
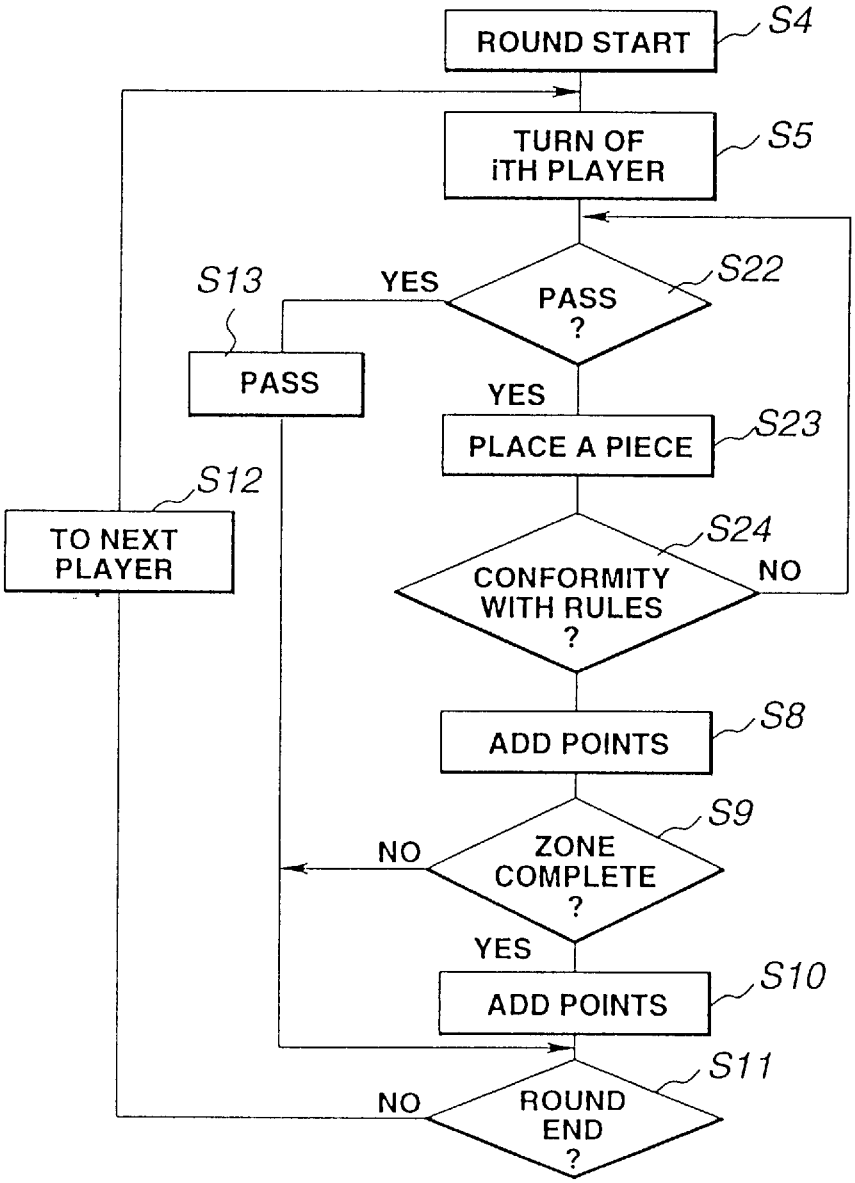
FIG. 14 is a flowchart showing a variation of the process of FIG. 12.

FIG. 14 shows a variation of the playing process shown in FIG. 12. The program section of the steps S6 and S7 of FIG. 12 is replaced by the program section of steps S22~24 as shown in FIG. 14.

After the step S5, the game system proceeds to the step S22 and checks whether there is a command from the ith player to pass, or not. If there is not, the system proceeds to a step S23 to allow the ith player to place a piece on the board.

At the step S24 following the step 523, the system checks whether the placement of a piece at the step S23 is in conformity with the required conditions or rules. If the answer of the step S24 is YES, the system proceeds to the next step S8. If the answer of the step S24 is NO, then the system returns to the step S22.

It is possible to implement the board game according to the present invention in the form of a computer game or video game. The game system and/or the playing process according to the present invention may be in the form of a program stored in a compact disc read only memory, or other storage medium.

The board game according to the present invention as explained above is new, simple, easy to play, exciting, and capable of removing limitation by age.

What is claimed is:

1. A playing process of playing a board game, comprising:

a preparing step of preparing a game board having a regular pattern of a predetermined number of unit equilateral triangles defined by regularly arranged grid lines, said regular pattern comprising a frame formed by a plurality of said unit equilateral triangles;

a distributing step of distributing a predetermined set of playing pieces among players so that each player has a predetermined subset of playing pieces, each of said playing pieces being in a form of a polygonal figure which can be superimposed on the pattern so that each side of the polygonal figure lies on one of the grid lines, each of said playing pieces belonging to one of a number of groups into which said playing pieces are classified by shape, the playing pieces of each group being identical in shape and size with one another, the playing pieces of each group being different in shape and size from the playing pieces of any other group; and a forming step of forming a polygonal mosaic on the board by allowing each player in turn to place one piece on the board in such a manner that an entirety of one side of a newly placed piece adjoins one side of the polygonal mosaic on the board and that each side of the newly placed piece lies on one of the grid lines;

wherein said forming step comprises a first sub-step of allowing a first piece to be placed on the board if the first piece is within the frame and each side of the first piece lies on one of the grid lines.

2. A playing process as claimed in claim 1 wherein said frame has a shape of a regular convex hexagon.

3. A playing process as claimed in claim 2 wherein said set of playing pieces comprises small triangular pieces having a shape of a small equilateral triangle, large triangular pieces having a shape of a large equilateral triangle greater than the small equilateral triangle, small rhombic pieces having a shape of a small rhombus, large rhombic pieces having a shape of a large rhombus greater than the small rhombus, small trapezoidal pieces having a shape of a small trapezoid, large trapezoidal pieces having a shape of a large trapezoid greater than the small trapezoid, and hexagonal pieces having a shape of a regular hexagon.

4. A playing process as claimed in claim 3 wherein said frame is a center frame and surrounded by six peripheral frames each of which has a shape congruent with the shape of said center frame and each of which has one side adjoining a unique one of the six sides of the center frame.

5. A playing process as claimed in claim 4 wherein each of said frames is made up of 24 of the unit equilateral triangles.

6. A playing process as claimed in claim 5 wherein the small equilateral triangle of the small triangular pieces is congruent with each of said unit equilateral triangles, the large equilateral triangle of the large triangular pieces is congruent with a fourfold equilateral triangle defined by four of said unit equilateral triangles, the small rhombus of the small rhombic pieces is congruent with a rhombus defined by two of said unit equilateral triangles, the large rhombus of the rhombic triangular pieces is congruent with a rhombus defined by eight of said unit equilateral triangles, the small trapezoid of the small trapezoidal pieces is congruent with a trapezoid defined by three of said unit said unit equilateral triangles, the large trapezoid of the large trapezoidal pieces is congruent with a trapezoid defined by twelve of said unit equilateral triangles, and the hexagon of said hexagonal pieces is congruent with a regular hexagon defined by six of said unit equilateral triangles.

7. A playing process as claimed in claim 6 wherein said first sub-step of said forming step comprises a first operation for allowing a first piece to be placed on the board if the first piece is within said center frame, an entirety of at least one side of the first piece is in contact with one side of said center frame, and each side of the first piece extends on and along one of the grid lines, and said forming step further comprises a subsequent sub-step of allowing a subsequent piece to be placed on the board if an entirety of at least one side of the subsequent piece is in contact with one side of the polygonal mosaic formed by at least one piece on the board, each side of the subsequent piece extends on and along one of the grid lines and any side of the subsequent piece which is in contact with one side of said polygonal mosaic is equal in length to, or shorter than, said one side of said polygonal mosaic and bounded between both ends of said one side of said polygonal mosaic.

8. A playing process as claimed in claim 7 wherein said process further comprises a scoring step for determining a total score of each player by multiplying a predetermined reward of points by a number of joints made by the player, each of said joints being a place where one side of a newly placed piece is in contact with one side of said polygonal mosaic if there is said mosaic on the board, and in contact with one side of said center frame if there is no piece on the board.

9. A playing process as claimed in claim 8 wherein each of said peripheral frames is assigned a bonus of points which is to be given if a newly place piece fills a remaining unoccupied open space in the frame so that the number of unoccupied open unit triangles in the frame is reduced to zero, and the total score of each player is a sum of a product resulting from multiplication of the reward of points by the number of joints, and an additional term determined by the bonuses of the peripheral frames.

10. A playing process as claimed in claim 9 wherein the reward of points is 5 points, and the bonus of three of said peripheral frames are equal to 10 points, and the bonus of the remaining three of said peripheral frames are equal to 30 points, and the three peripheral frames having the bonus of 30 points and the three peripheral frames having the bonus of 10 points are arranged alternately around the center frame.

11. A playing process as claimed in claim 1, wherein at least two of the groups of playing pieces are large piece groups, each of which includes playing pieces which are in a form of a polygonal figure formed by a predetermined number of unit equilateral triangles.

12. A playing process according to claim 11, wherein said second step comprises a second sub-step of allowing each player, in turn according to a predetermined order, to place a piece selected from his predetermined subset of playing pieces on the pattern such that the selected piece is connected to the covering figure, without overlapping the covering figure, to expand the covering figure when the selected piece has both a connected part extending on one side of the covering figure and an unconnected part projecting from the covering figure, and the selected piece forms a joint line along which the selected piece is in contact with the covering figure along a full length of one of the sides of the selected piece; and wherein said second step further comprises a third sub-step of adding a predetermined number of points to the score of a player when the player makes one joint line by placing one of the pieces of the subset held by the player.

13. A playing process as claimed in claim 1, wherein said process further comprises a scoring step for determining a total score of each player by multiplying a predetermined reward of points by a number of points made by the player, wherein a point is made when one side of a first played piece contacts one side of said frame and a point is made when one side of a newly placed piece contacts one side of a polygonal mosaic on the board.

14. A playing process as claimed in claim 1, wherein the forming step comprises a subsequent sub-step of forming the polygonal mosaic on the board by allowing one piece at a time to be incorporated into the polygonal mosaic on the board, and preventing removal of any piece of the polygonal mosaic from the board.

15. A playing process of playing a board game, said playing process comprising:

a first step of preparing a regular periodic board pattern completely covered by unit polygonal figures in a shape of a regular polygon defined by regularly arranged grid lines, and containing various large polygonal figures which include a plurality of the unit polygonal figures; and a second step of allowing polygonal pieces to be superimposed on the board pattern so that each piece coincides with one of the polygonal figures in the board pattern and the pieces are connected to form a covering polygonal figure occupying a plurality of the unit polygonal figures in the pattern, and of rejecting a new polygonal piece unless the new polygonal piece is coincident with one of the polygonal figures in the pattern, and an entirety of at least one side of the new polygonal piece is in contact with one side of the covering polygonal figure, wherein said second step comprises a distributing sub-step of distributing the polygonal pieces among the players so that each player holds a predetermine subset of polygonal pieces, each of said polygonal pieces belonging to one of a number of groups into which said polygonal pieces are classified by shape, the polygonal pieces of each group being identical in shape with one another, the shape of the polygonal pieces of each group being different from the shape of any other group, and wherein said second step further comprises a first forming sub-step of allowing one of the pieces to be placed first on the pattern to create the covering figure when the piece is located in a predetermined central polygonal figure and a full length of one side of the piece is in contact with at least one of the sides of the central polygonal figure.

* * * * *